US006032948A

United States Patent [19]

Peebles et al.

[11] Patent Number: 6,032,948

[45] Date of Patent: Mar. 7, 2000

[54] APPARATUS FOR STACKING SHEETS

[75] Inventors: John A. Peebles; Ahmad H. Ebrahimi, both of Dundee, United Kingdom

[73] Assignee: NCR Corporation, Dayton, Ohio

[21] Appl. No.: 09/079,739

[22] Filed: May 15, 1998

[30] Foreign Application Priority Data

Sep. 2, 1997 [GB] United Kingdom ..... 9718467

[51] Int. Cl.[7] ..... B65H 31/20

[52] U.S. Cl. ..... 271/224

[58] Field of Search ..... 271/220, 223, 271/224, 207, 306

[56] References Cited

FOREIGN PATENT DOCUMENTS 4350060 12/1992 Japan ..... 271/223

*Primary Examiner*—David H. Bollinger

[57] ABSTRACT

A bill stacker (30) to handle bills of different sizes in an automated teller machine (10) includes two matched sets of different length arms (60a–e) with returns (62a–e) that act as bill stoppers where the arms are pivoted about a common shaft (64). Bills having the greatest width are engaged and stopped by the longest arms and bills of the shortest width are engaged and stopped by the shortest arms, with intermediate width bills being stopped by intermediate length arms. The arms are brought into position by means of two sets of cams (66a–e) so as to bring about the alignment of bills dynamically as bills are fed into the stacker in order of decreasing width.

18 Claims, 11 Drawing Sheets

APPARATUS FOR STACKING SHEETS

BACKGROUND OF THE INVENTION

The present invention relates to an apparatus for stacking sheets such as bank notes where bank notes are henceforth to be referred to as bills.

Self-service terminals, such as automated teller machines (ATMs) can dispense cash. The currency dispensed may comprise bills of different denominations and hence possibly different sizes. Also, bills can vary in size from country to country.

In a known ATM, before bills are presented by the ATM to a user they are stacked and aligned against a common edge. Existing stacking methods for bills of different sizes utilize linearly moveable stop surfaces which only partially block the path of a bill being added to the stack due to the need to provide adequate clearance over the accumulating stack of bills. A problem is that some bills may get past the stop thus causing a jam or getting lost. Also, existing stackers use stacking wheel arrangements that require considerable space.

SUMMARY OF THE INVENTION

It is an object of the present invention to provide a new apparatus for stacking sheets that alleviates the above problems.

According to the present invention there is provided an apparatus for stacking sheets of a plurality of sizes comprising sheet supporting means, sheet transport means, and data processing means for controlling said sheet transport means, characterized by at least one set of elongated members rotatable about a common axis where length from said axis of each member of a set varies, and rotatable means controlled by said data processing means to rotate each member of a set individually so that when each member is rotated it can act as a stop for a size of sheet as said size of sheet is supported by said sheet supporting means.

BRIEF DESCRIPTION OF THE DRAWINGS

One embodiment of the invention will now be described by way of example with reference to the accompanying drawings, in which.

DETAILED DESCRIPTION

Figure 1:
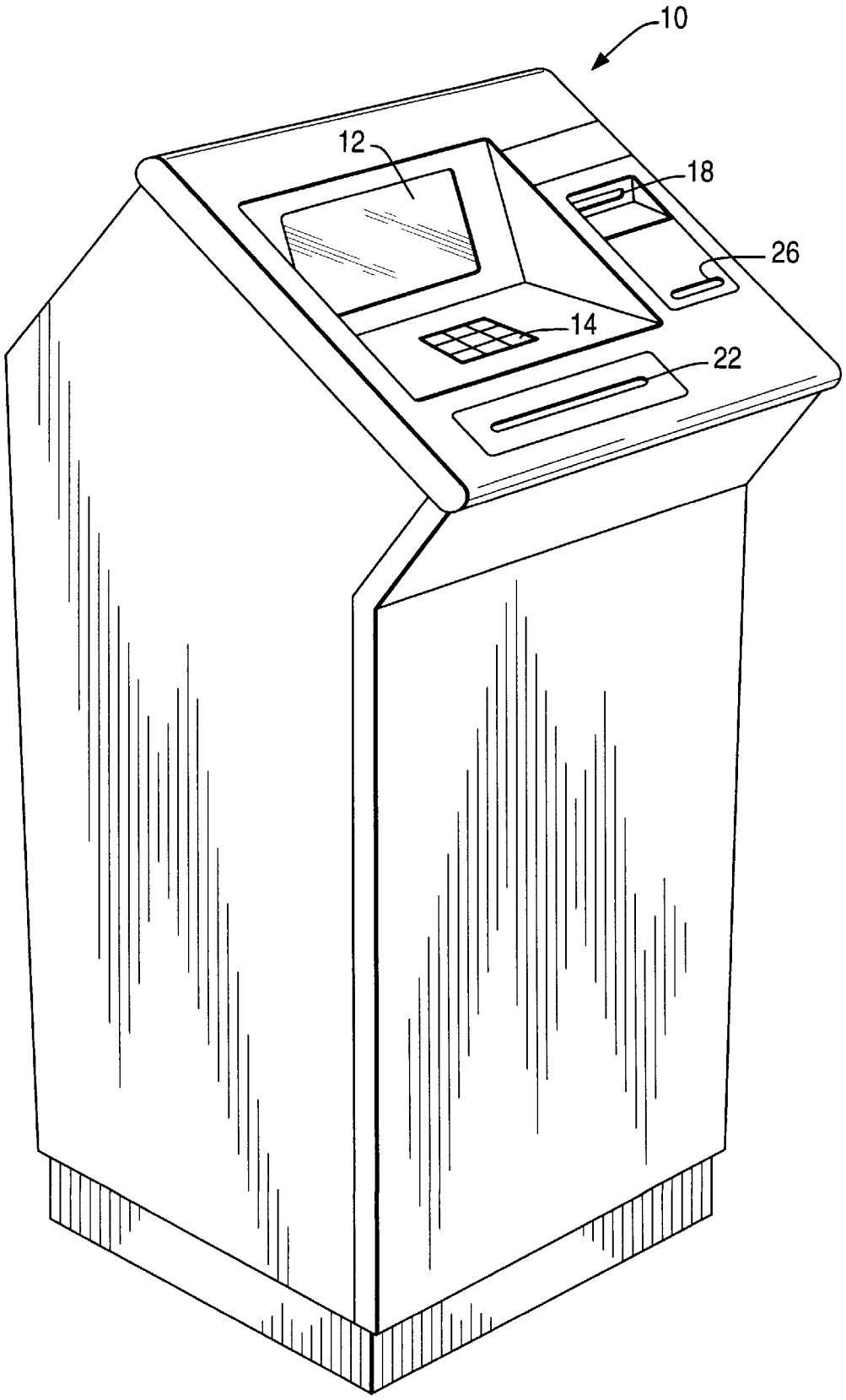
FIG. 1 is a perspective view of an ATM in which a bill stacker in accordance with the invention is included.
Figure 2:
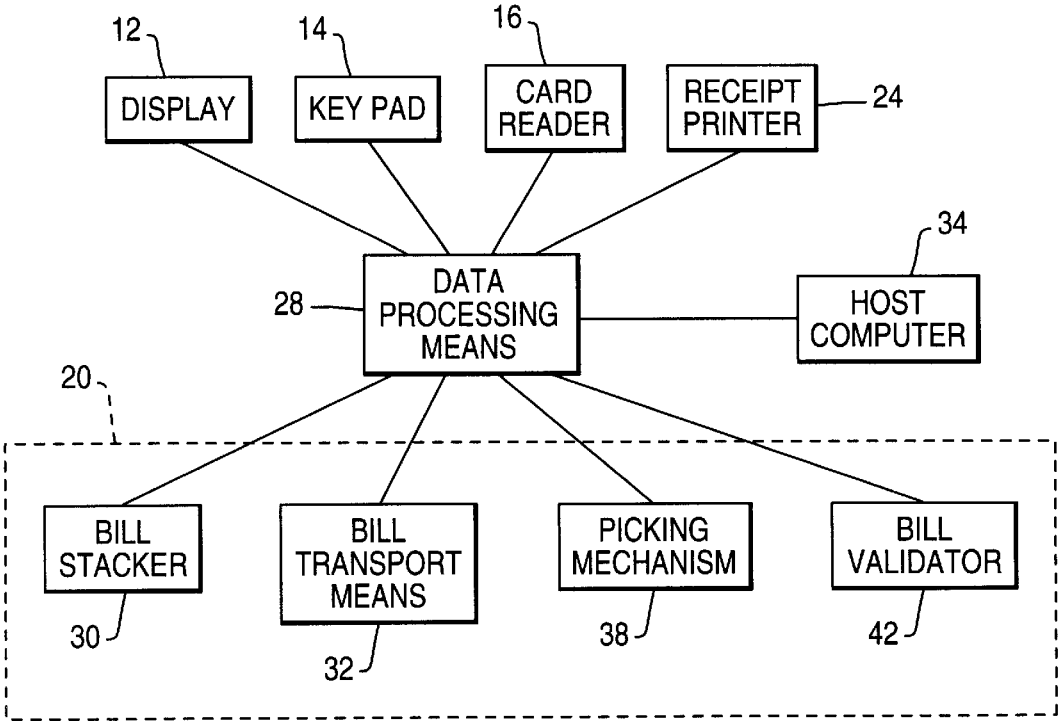
FIG. 2 is a block diagram of the ATM of FIG. 1.

Referring to FIGS. 1 and 2, the ATM 10 shown therein includes a display 12 for displaying user information, a key pad 14 for inputting data, a card reader 16 for receiving a user identity card via a card slot 18, a cash dispenser 20 where currency bills stored in the dispenser 20 are delivered to a user during a transaction via a slot 22, a receipt printer 24 for printing a receipt acknowledging a transaction made by a user and for issuing the receipt to the user via a slot 26, and data processing means 28 to which the display 12, the key pad 14, the card reader 16, the cash dispensing mechanism 20 and the receipt printer 24 are connected. The cash dispensing mechanism 20 includes a bill stacker 30 in accordance with the invention (to be described in more detail later) and bill transport means 32.

To make a withdrawal, a user inserts his identification card in the card slot 18 of the ATM 10. Data contained in a magnetic strip on the card is read by the card reader 16 and transmitted by the data processing means 28 to a host computer 34. The user identifies himself by entering his personal identity number via the key pad 14. If the host computer 34 authorizes the card then the user can proceed with his withdrawal by first entering details of the transaction, e.g. the amount of the withdrawal, by means of the key pad 14.

Figure 3:
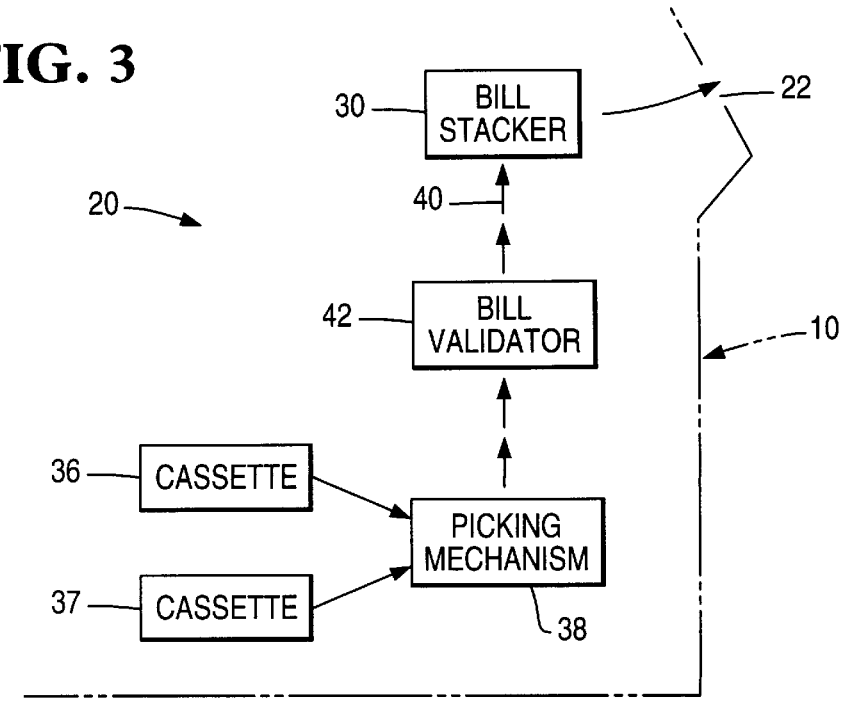
FIG. 3 is a schematic representation of a cash dispensing means including the bill stacker included in the ATM of FIG. 1.

Referring now to FIG. 3, the cash dispensing means 20 includes two currency cassettes 36,37 each arranged to contain a stack of currency bills. The currency bills in a cassette are of the same pre-determined denomination (supported on their long edges). In this embodiment, the bills held in cassette 36 are of a minimum width whereas those held in cassette 37 are of a maximum width. The maximum and minimum width bills are used to illustrate either end of the range of notes that the bill stacker 30 can take. The cassettes 36,37 are associated with a conventional pick mechanism 38.

When a request for a cash withdrawal is made and approved, the data processing means 28 directs the pick mechanism 38 to pick bills from at least one cassette. It is known for a data processing means to have a stored record of the denomination (and hence size) of bill contained in a cassette. If bills are to be picked from both cassettes 36,37 then the pick mechanism 38 will pick from cassette 37 first since this contains the wider bills. Each bill is picked singly and the bills are individually passed along a feed path (indicated by arrows 40) by the transport means 32. The feed path 40 takes each bill through a conventional bill validator 42. If the bill validator 42 does not accept the bill or the bill is a multiple bill then it is rejected. Otherwise the bill continues to be transported along the feed path 40 to the stacker 30. The bills are then stacked and transported to the cash dispensing slot 22 for presentation to the user. Note that the bills travel through the cash dispensing means 20 with long edges leading.

Figure 4:
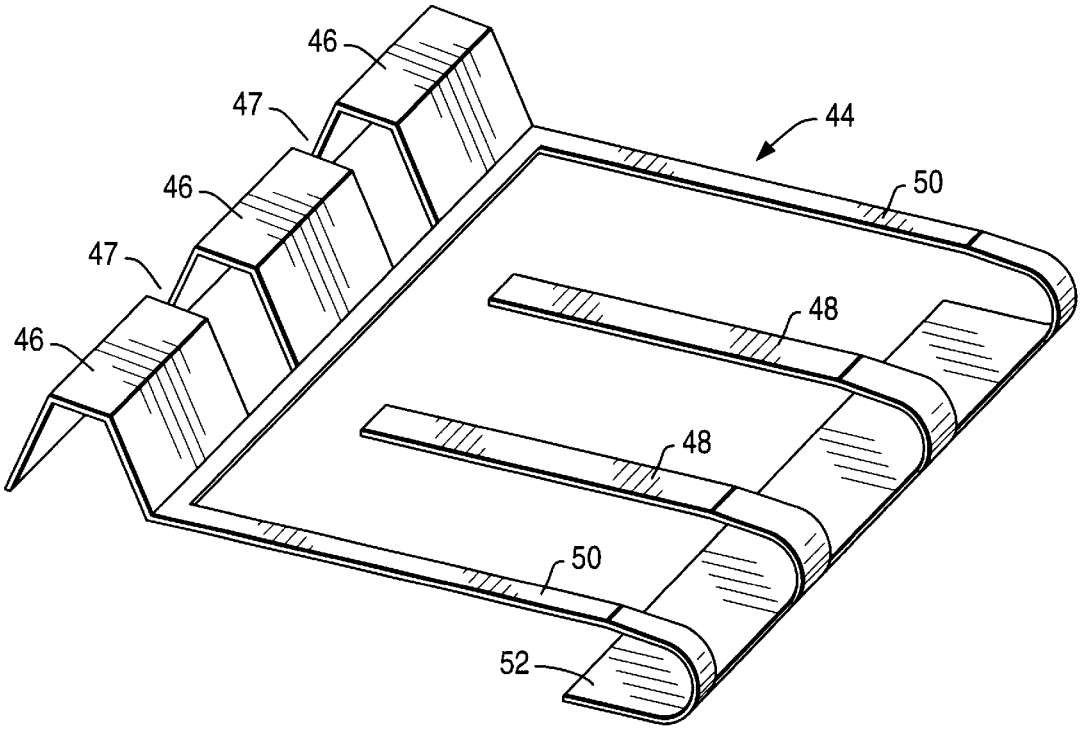
FIG. 4 is an isometric view of the receiving tray that forms part of the bill stacker.
Figure 5:
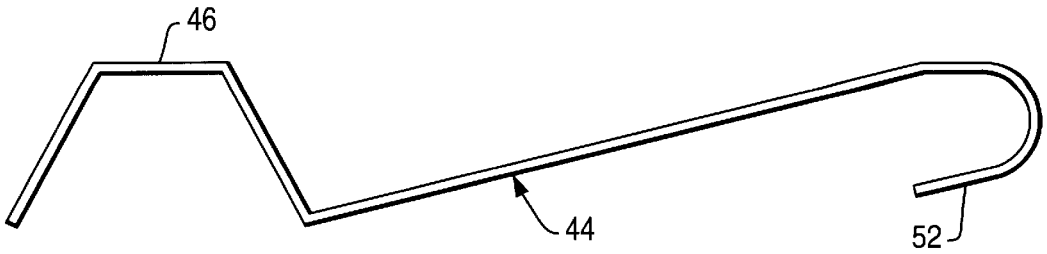
FIGS. 5 and 6 are a side elevational view and a plan view respectively of the receiving tray of FIG. 4.
Figure 6:
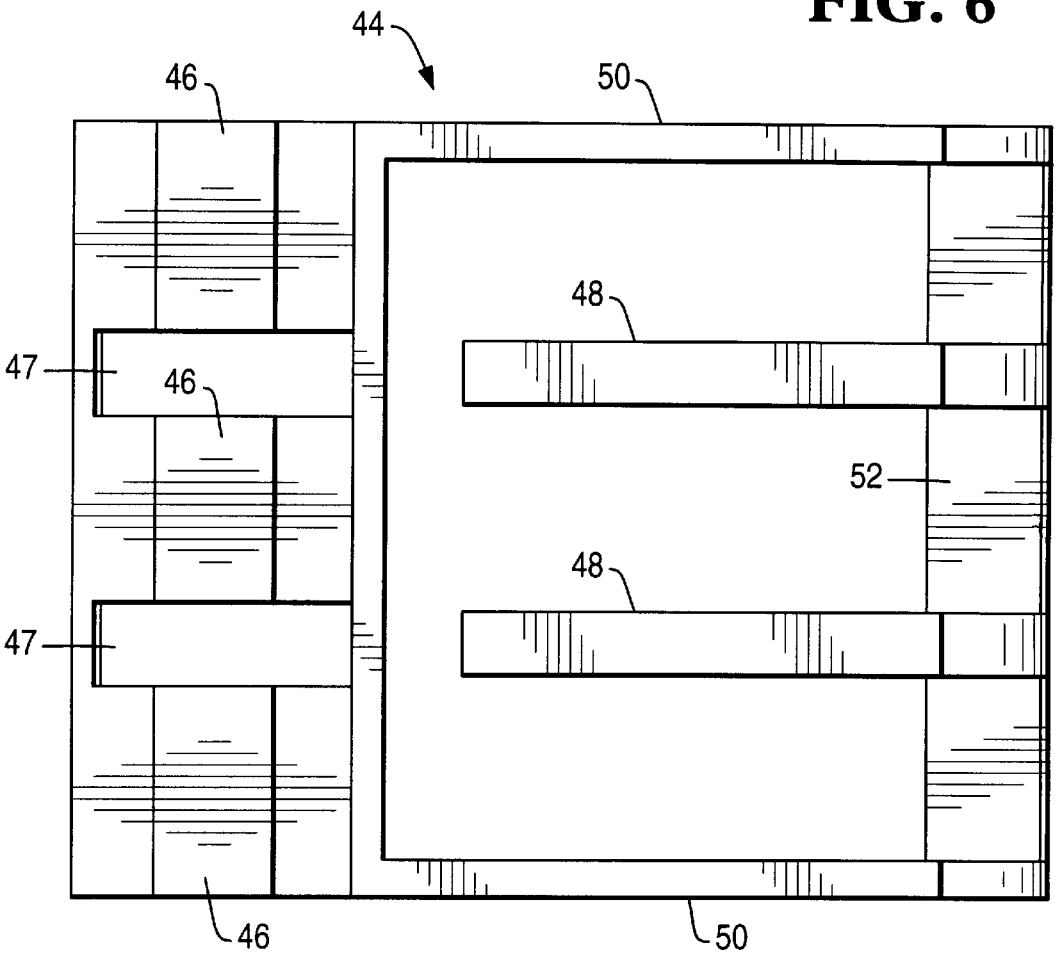

Referring to FIGS. 4, 5 and 6, a receiving tray 44 included in the stacker 30 is shown on which bills are stacked. The receiving tray 44 includes three inverted U-shaped units 46 at one end separated from each other by two intervening gaps 47 over which bills to be stacked are passed. Received bills are stacked on two tongues 48 which are located between and parallel to two side edges 50; the long edges of the bills are perpendicular to the tongues 48. The tongues 48 and side edges are tilted at an angle so that at the end of the tray opposite to the inverted U-shaped units 46, they are almost at the same level as the top of the units 46. The two tongues 48 are not directly connected to the units 46, but are connected to the rest of the receiving tray 44 by a base 52 which is at the opposite end of the tray 44 to the inverted U-shaped units 46. The side edges 50 are connected both to the inverted U-shaped units 46 and to the base 52.

Figure 7A:
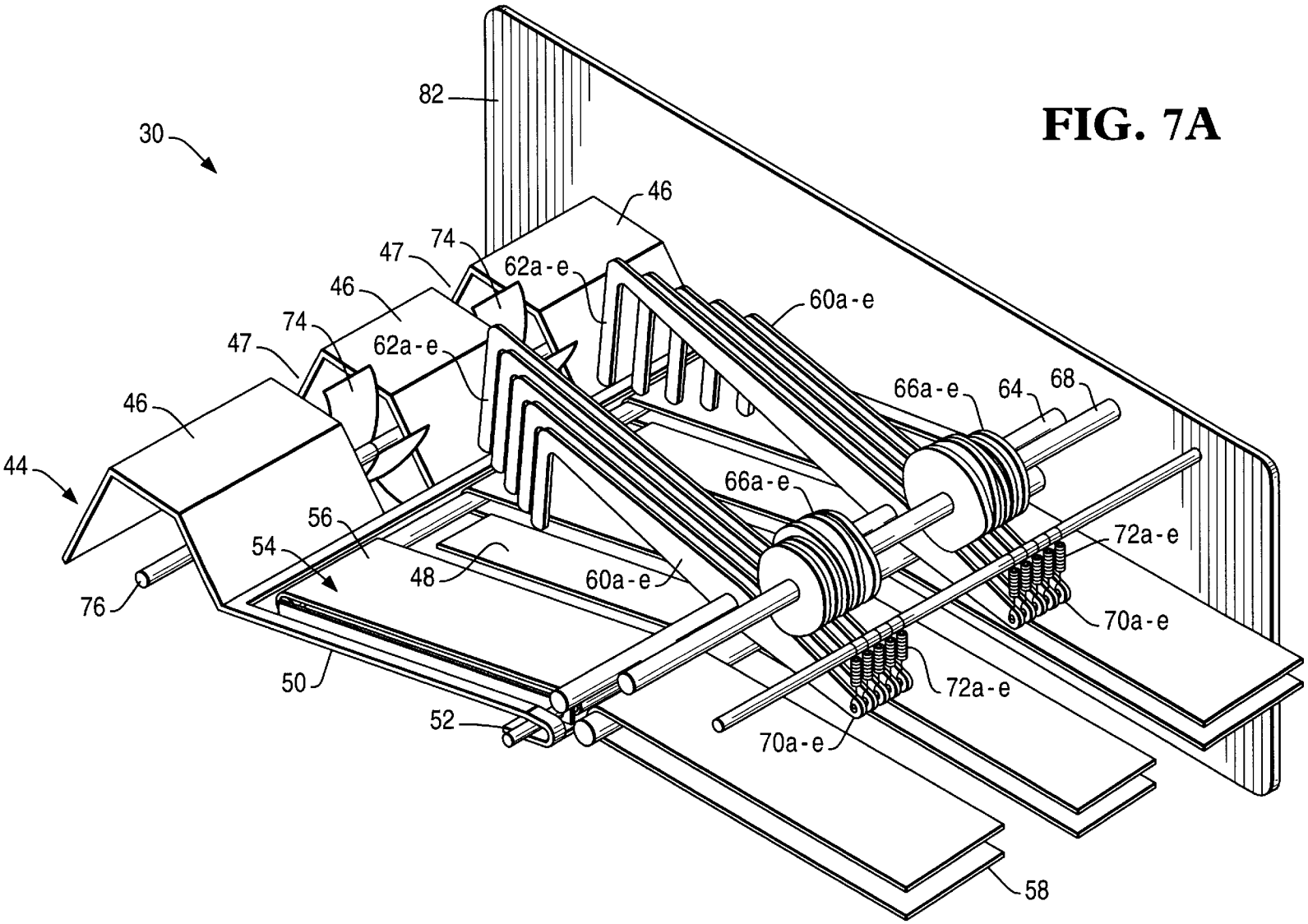
FIGS. 7A and 7B are isometric views of the bill stacker.

Referring to FIG. 7A, the stacker 30 includes a lower transport belt unit 54. The belt unit 54 includes three parallel belts 56 which have interspaced between them the two tongues 48 of the receiving tray 44. The tongues 44 are parallel to and slightly above the top surfaces of the belts 56. The lower transport unit 54 will be described in more detail later (see FIGS. 9 and 10). Another lower transport belt unit 58 also comprising three parallel belts is adjacent the first lower transport belt unit 54.

Above the belt units 54,58 are two sets of five bill stopping arms 60*a–e* where each arm has a return 62*a–e* that can act as a bill stopper. The returns 62*a–e* are aligned above the tongues 48 of the receiving tray 44. Each arm 60*a–e* of a set is of a different length and can be rotated downwardly onto the tongues 48 of the receiving tray 44. The sets of arms 60*a–e* rotate about a common axis 64 and are controlled in movement by the surfaces of two sets of cams 66*a–e* that can be rotated by a common shaft 68. The cams 66*a–e* are located on the opposite side of the axis 64 to the returns 62*a–e*. The ends 70*a–e* of the arms 60*a–e* opposite to the returns 62*a–e* are attached to springs 72*a–e* that force the returns 62*a–e* downwards when the cams 66*a–e* are rotated.

In the two gaps 47 interspaced between the three inverted U-shaped units 46 of the receiving tray 44 are located flexible strap flicker wheels 74 (one for each gap). The two flicker wheels 74 are on a common shaft 76 rotated by a motor (not shown) under the control of the data processing means 28.

Figure 7B:
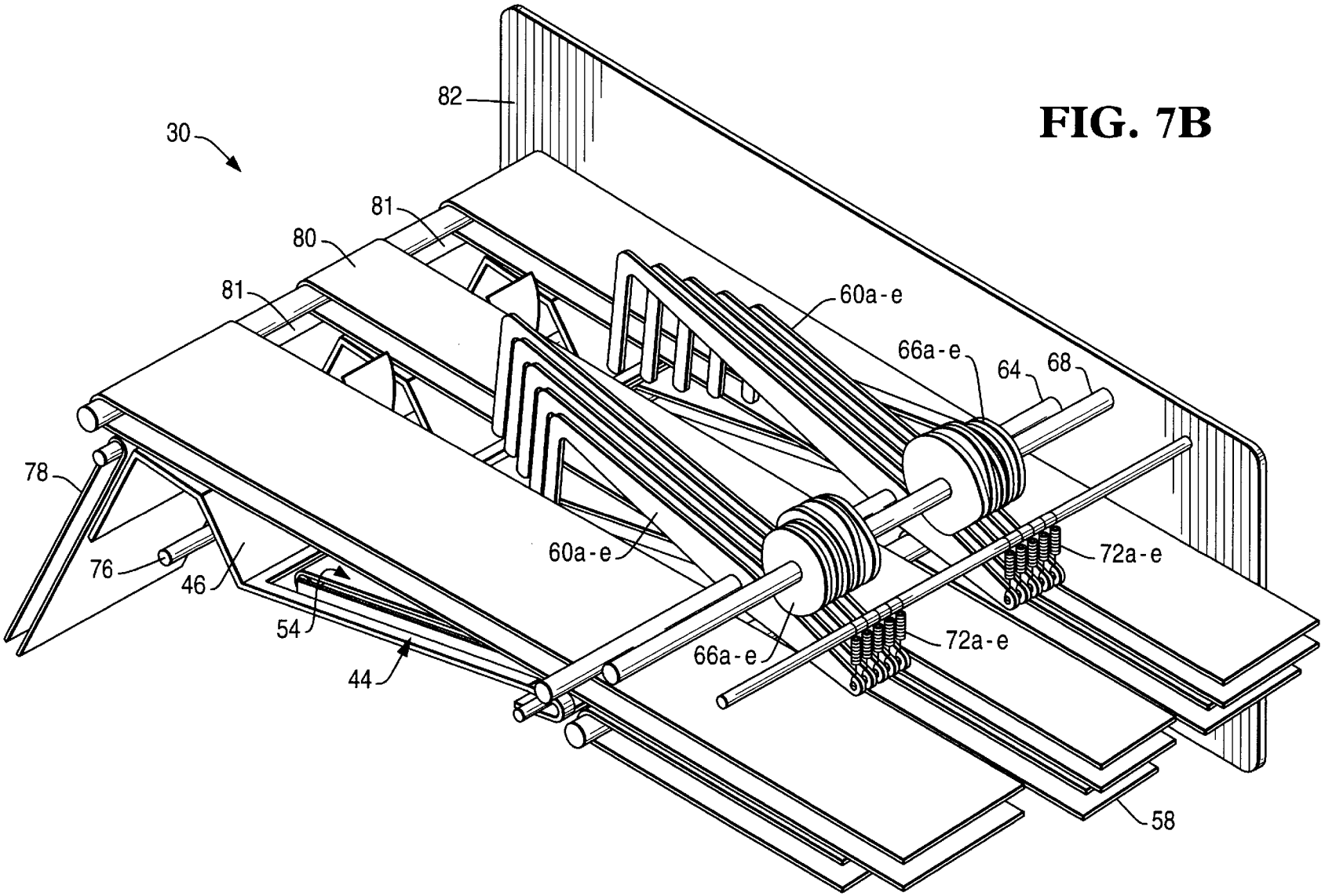

Referring to FIG. 7B, side belt transport unit 78 and upper transport belt unit 80 are shown. These have been omitted from FIG. 7A for clarity. The side belt unit 78 is located by the inverted U-shaped units 46 at one end of the receiving tray 44. The upper belt unit 80 is located above the top of the inverted U-shaped units 46 and lower transport belt unit 58.

All transport belt units 54,58,78,80 are under the control of the data processing means 28. Each transport belt unit 54,58,78,80 comprises three parallel belts turned by common rollers. Interspaced between the three belts are two gaps. Each of the two sets of arms 60*a–e* of the stacker 30 fit in each of the two gaps 81 of the upper transport belt unit 80 respectively. The three belts of the side unit 78 are aligned with the three inverted U-shaped units 46 of the receiving tray 44 respectively.

Only a single side unit 82 for supporting the internal arrangement of the stacker 30 has been shown in FIGS. 7A and 7B for clarity.

A typical operation of the stacker 30 will now be described.

Figure 8A:
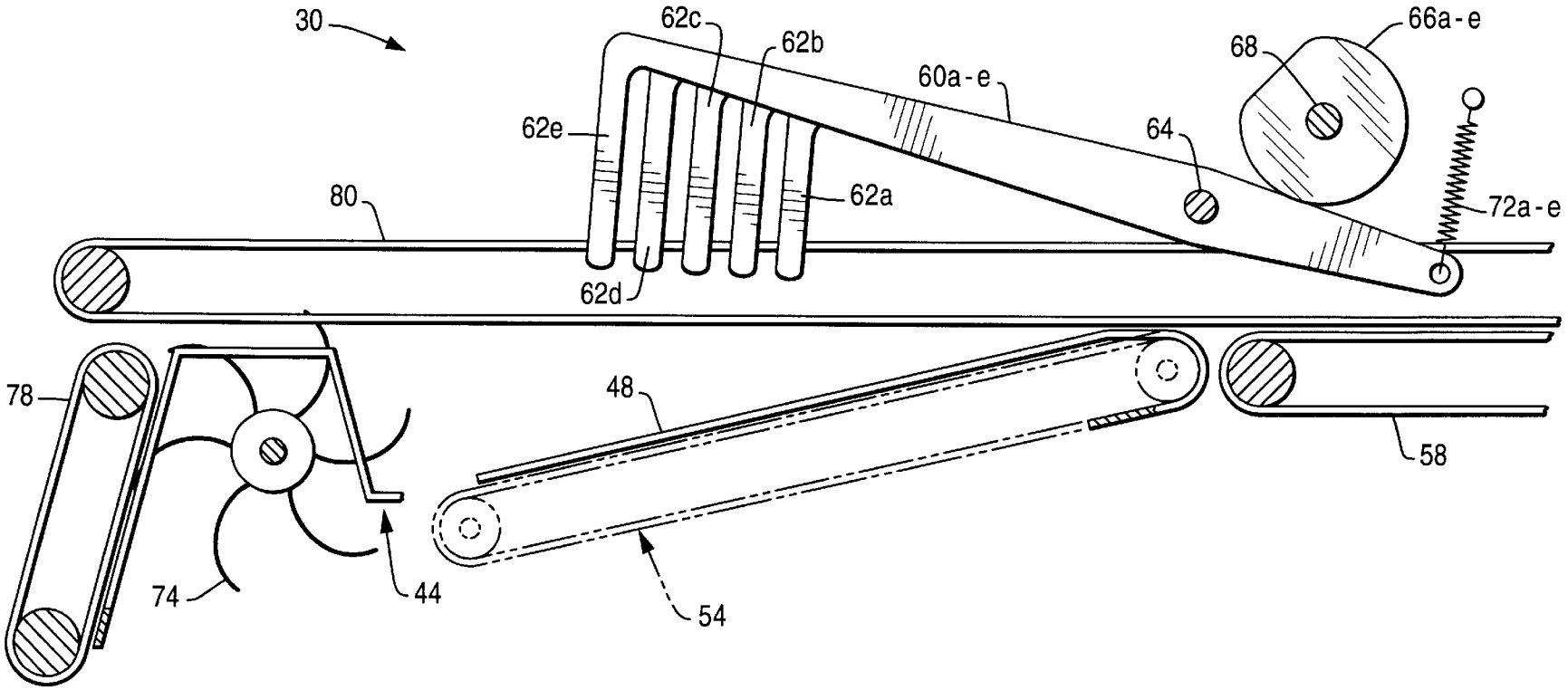
FIGS. 8A to 8D are sectional views of the bill stacker in various stages of use.

Referring to FIG. 8A, the two sets of arms 60*a–e* of the stacker 30 are initially held in a raised position by the cams 66*a–e* so that all the returns 62*a–e* are clear of the tongue 48 of the receiving tray 44. Each arm of a set differs in length from an adjacent arm by 10 millimeters whereby the longest arm 60*e* is 40 millimeters longer than the shortest arm 60*a*. The lower belt transport unit 54 has been shown in dashed lines for clarity.

Figure 8B:
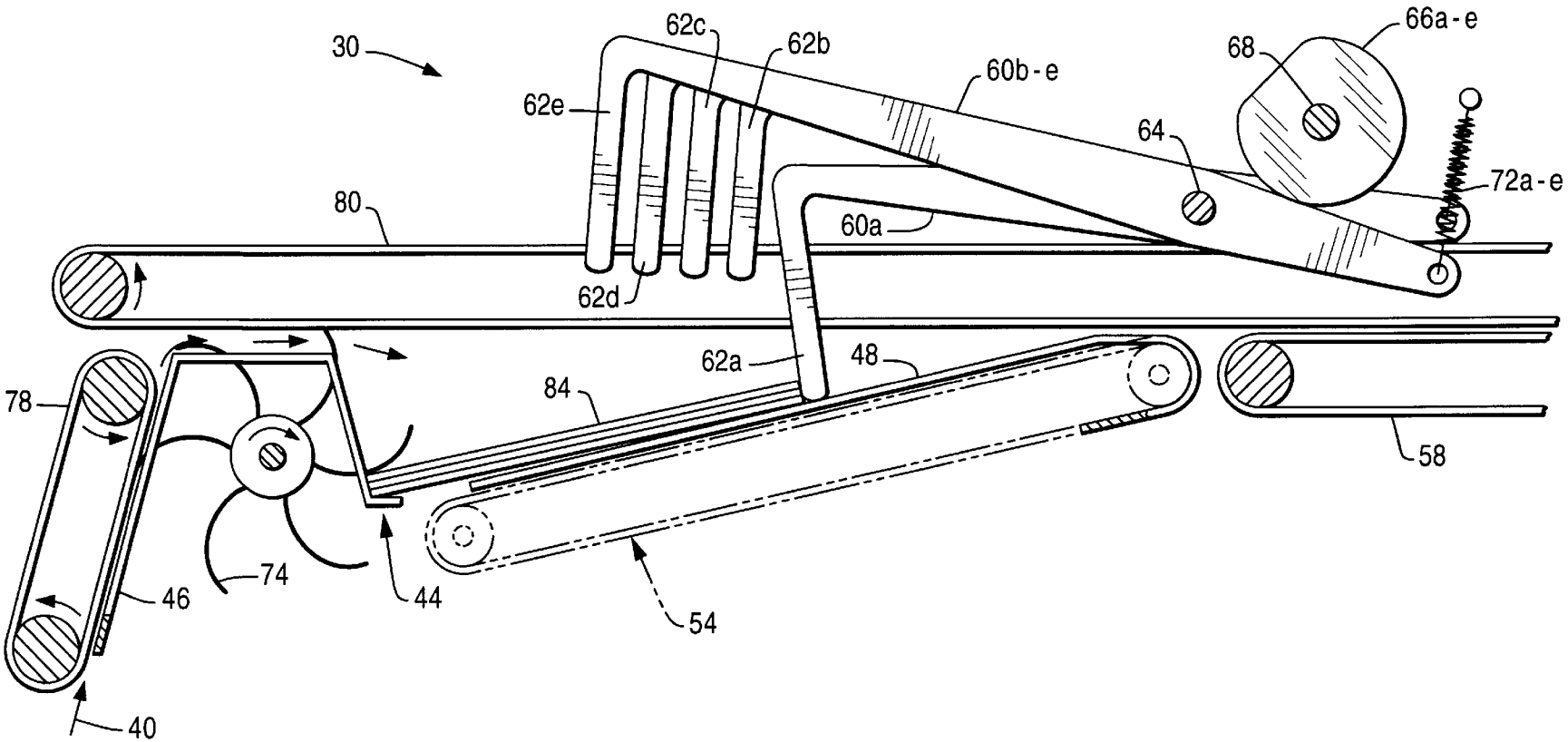

Referring to FIG. 8B, the cam shaft 68 is driven by a conventional motor (not shown) under the control of the data processing means 28. The shaft 68 is rotated so that the surface of the two sets of cams 66*a–e* cause the shortest arm 60*a* of each set to be rotated so that the returns 62*a* contacts the tongues 48 of the receiving tray 44; it is now ready to receive the maximum width bills from cassette 37 (see FIG. 3). Bills are individually fed sideways into the receiving tray 44 as indicated by the feed path arrows 40. Bills travel between the edges of the inverted U-shaped units 46 of the receiving tray 44, and the side transport belt unit 78 and the upper transport belt unit 80. They are stopped by the returns 62*a* and land on the tongues 48. When the leading edge of each bill is arrested by the returns 62*a* of arms 60*a* the trailing edge of the bill is propelled downwards by means of the action of the two flexible strap flicker wheels 74. The next maximum width bill is then fed into the tray 44 where as a result of the speed of transport of the bill the leading edge of the bill passes over the stationary first bill. The bill is stopped by returns 62*a* and the trailing edge of this second bill is then forced down by the flicker wheels 74. This is continued until all the maximum width bills are picked and form a stack 84 on the receiving tray 44.

Figure 8C:
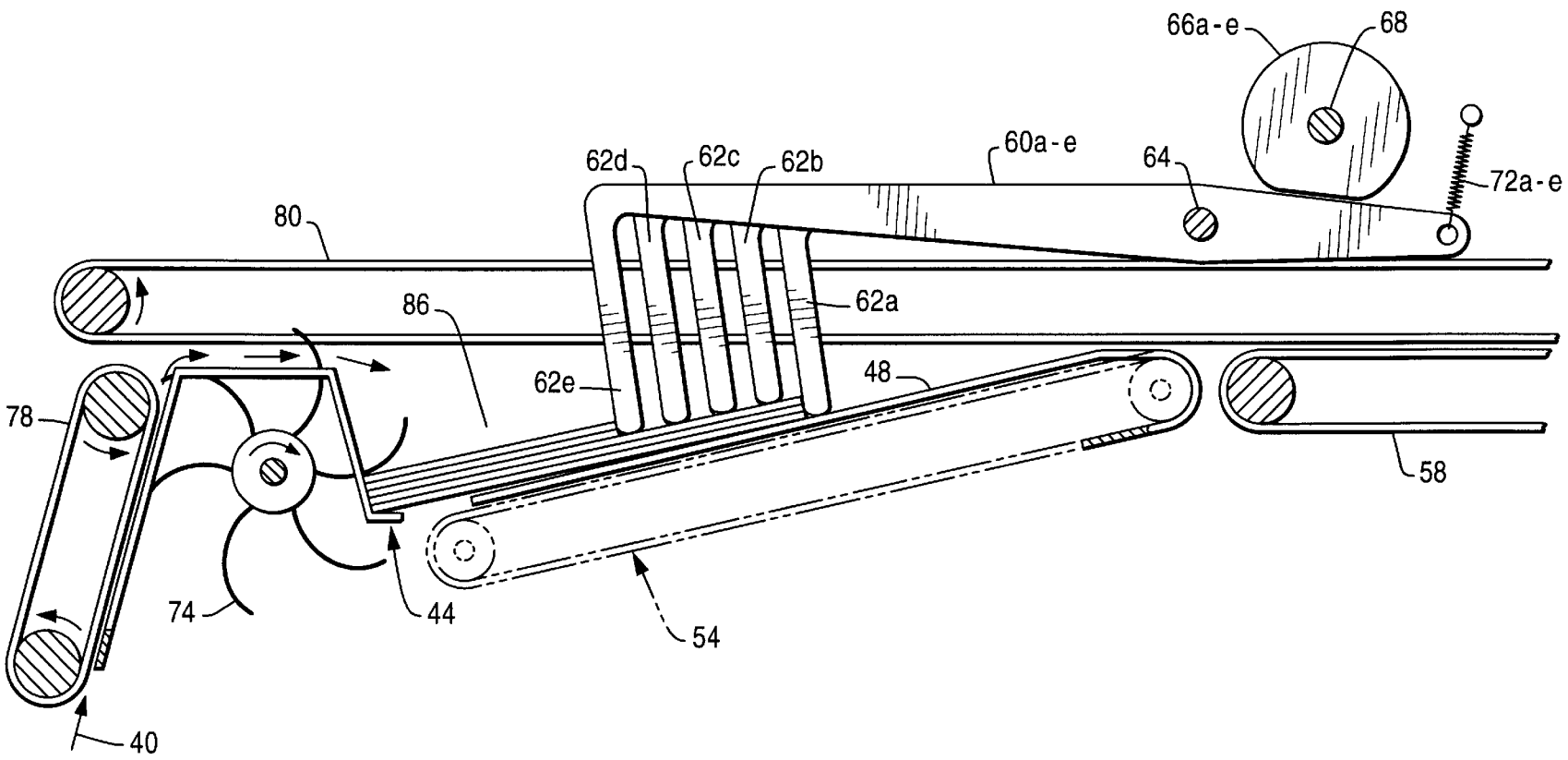

Referring to FIG. 8C, the data processing means 28 then causes the motor to rotate the shaft 68 so that the returns 62*b–e* of arms 60*b–e* are successively lowered onto the top of the stack of maximum width bills held in the tray 44 until the returns 62*e* of arms 60*e* have been lowered into position to act as a stop for the minimum width bills to be picked. The returns 62*b–e* lightly clamp the maximum width bills. The data processing means 28 has a stored record of the type of bills to be picked and so it causes the shaft 68 to rotate turning the two sets of cams 66*a–e* sufficiently so that their surfaces causes the right number of arms to be rotated into the receiving tray 44 (and onto any notes stacked there) to form a shortened space 86 that fits the next width of note to be picked.

The minimum width bills are then individually dispensed as shown by the feed path 40 into the shortened space 86 on top of the stack of maximum width bills and the trailing edges of the minimum width bills are propelled downwards by the flicker wheels 74 so that there is a common alignment of the trailing edge of the maximum width bills and minimum width bills.

Figure 8D:
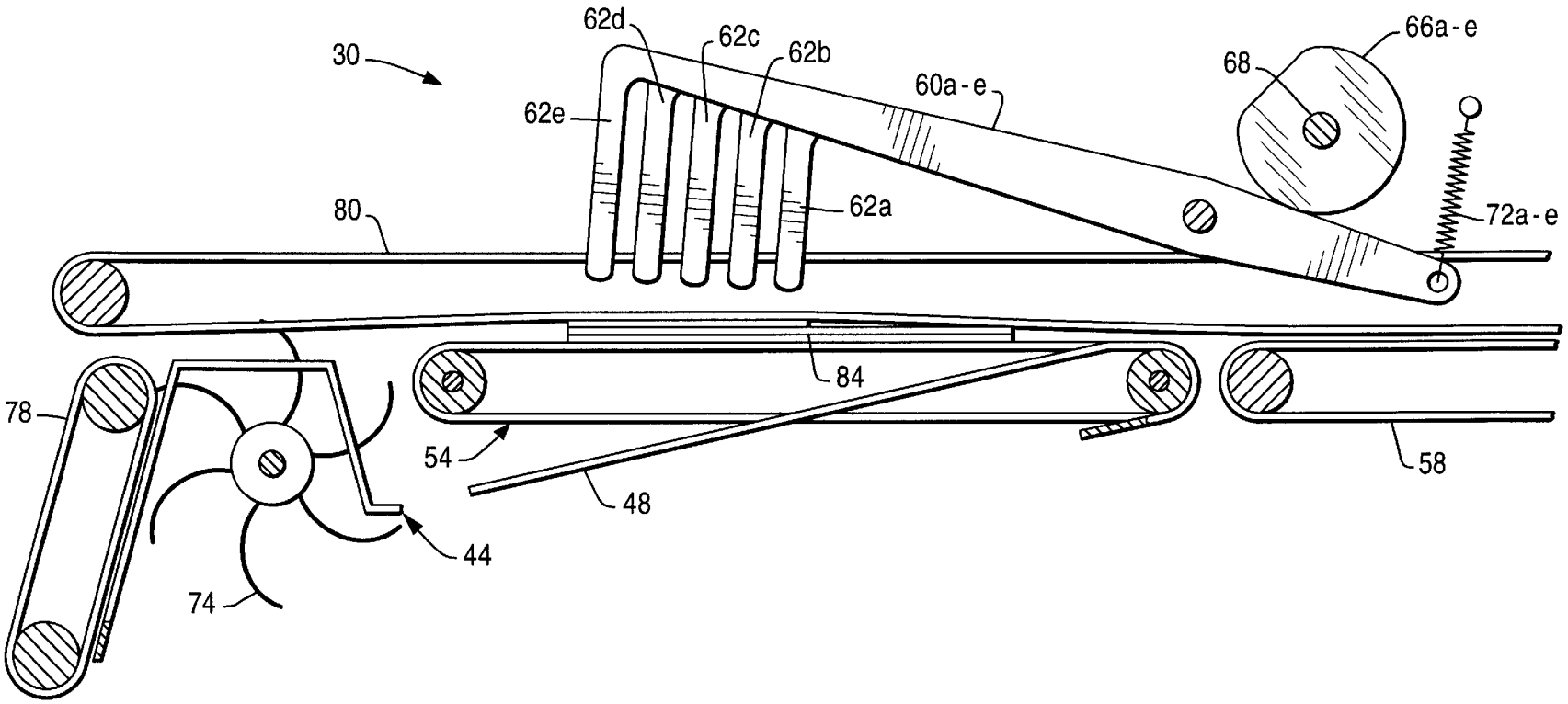

Referring to FIG. 8D, when the data processing means 28 has recorded by conventional means that all the bills required for the withdrawal have been loaded into the receiving tray 44 the transport belt units 78,80 are stopped and the two sets of cams 66*a–e* are rotated into a position such that all the returns 62*a–e* are clear of the base of the upper transport belt unit 80. The lower transport belt unit 54 (now shown in solid outline) is then rotated upwards about a shaft 88 (see FIGS. 9 and 10) to lift the completed stack 84 of bills into contact with the upper transport belt unit 80.

Figure 9:
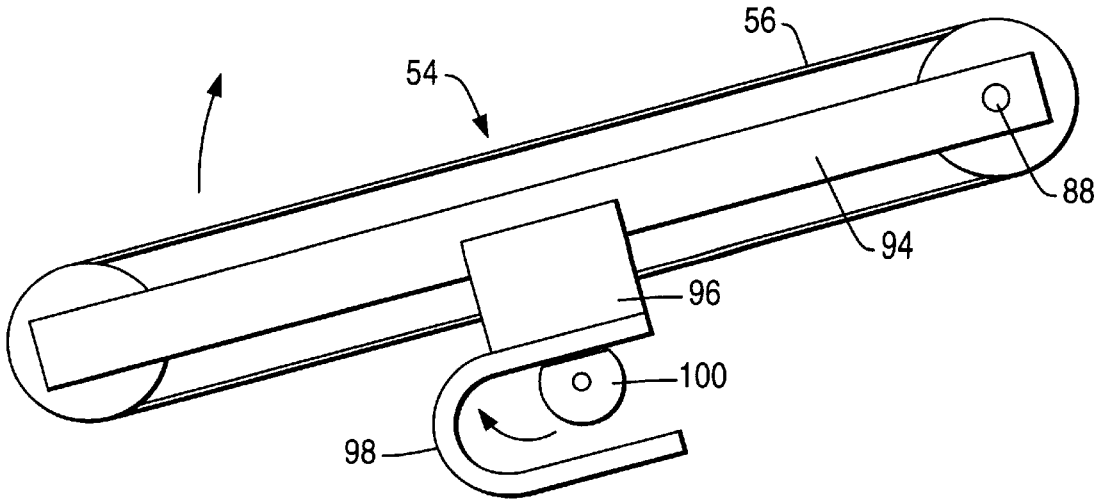
FIGS. 9 and 10 are a side elevational view and a plan view respectively of a lower transport belt unit that forms part of the bill stacker.
Figure 10:
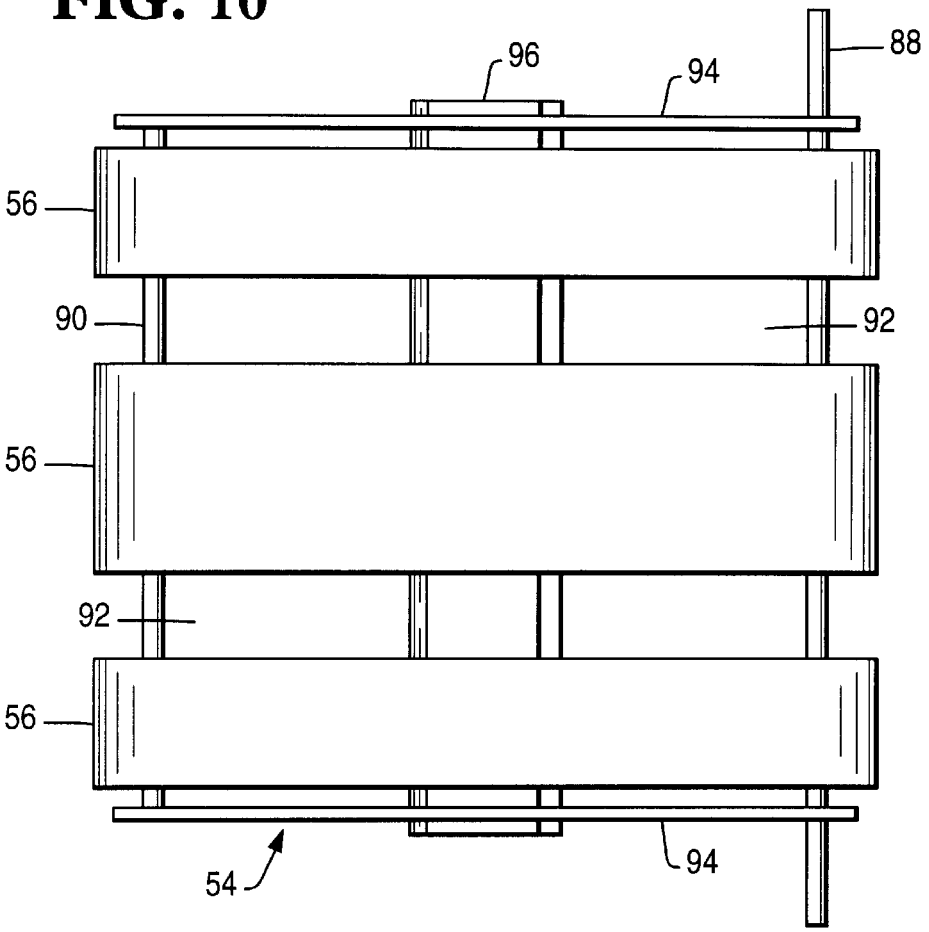

Referring to FIGS. 9 and 10, a side elevational view and a plan view of the lower transport belt unit 54 are shown. The lower transport belt unit 54, as mentioned above, includes three parallel belts 56. These rotate about rollers on two common shafts 88,90. The belt unit 54 can rotate around shaft 88 and is driven by this shaft 88. A conventional motor (not shown) under the control of the data processing means 28 rotates the shaft 88. The two gaps 92 between the three belts 78 provide space for the two fingers 48 of the receiving tray 44 (see FIGS. 6 and 7A). The belt unit 54 is held together by two side units 94 connected by a lower bracket 96. The base of the lower bracket 96 is fixed to one side of a U-shaped unit 98 inside of which is a cam 100. The cam 100 is driven by a conventional motor (not shown) under the control of the data processing means 28.

When all the bills have been stacked on the receiving tray 44, the cam 100 rotates. The surface of the cam 100 forces the underneath of the upper side of the U-shaped unit 98 upwards thus rotating the rest of the belt means 54 upwards about shaft 88 with shaft 90 clearing the receiving tray 44 (see FIG. 8D). This brings the stack 84 into contact with the upper transport belt unit 80 as mentioned earlier. The stack 84 of bills is then transported to the cash dispenser slot 22 for collection by the user.

Figure 11:
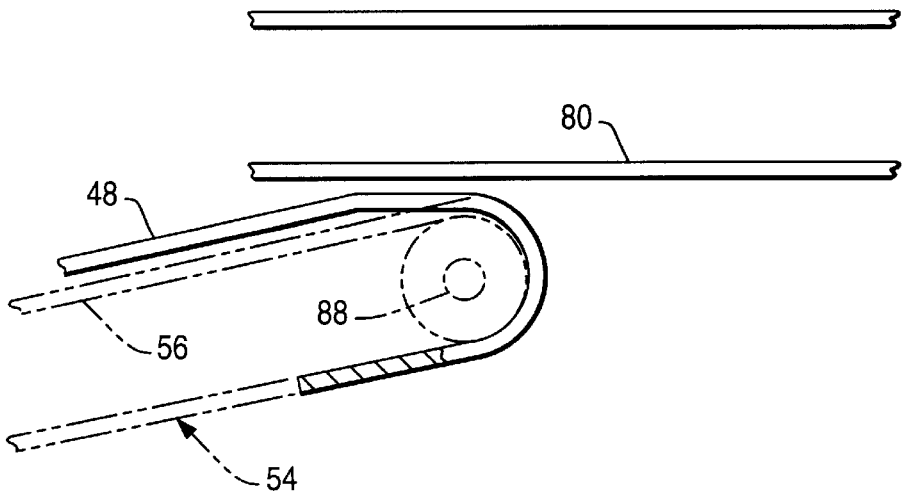
FIG. 11 (which is on the same sheet as FIG. 8A) is a sectional detail of the receiving tray and lower transport belt unit.

Referring to FIG. 11, and back to FIGS. 8A to 8C, it is shown that when the receiving tray 44 is receiving bills the tongues 48 of the tray 44 are generally just above the top surface of the belts 56 of the lower belt unit 54 (shown in chain dot). However, just by the roller on shaft 88 the tongues 48 and side edges 50 (not shown) will be at the same level as the belts 56 so that the belts 56 can be in close proximity with the upper transport belt unit 80.

Although the process described is for bills of two different widths stored in two cassettes the process can be used to stack bills of various denominations and widths and can use a higher number of cassettes.

The stacker provides considerable space saving when compared with conventional stacking wheel arrangements.

The stacker provides full blocking action and prevents disturbance of the stack of accumulated different sized bills by successive bills being added to the stack before the stack of bills is presented to the user.

ATMs may be configured to dispense cash from either the front or the rear of the machine, depending on whether the ATM is accessible for maintenance from either the rear or the front of the machine. It is easier to install the bill stacker described above to suit the configuration than a conventional stacking wheel arrangement.

For a conventional stacking mechanism, special presetting stops are required on the receiving tray. These need to match the maximum width currency of the country in which the ATM is used. In the inventive arrangement, the several arms of the stacker 30 allow most currencies to be stacked, thus removing the need for pre-setting.

What is claimed is:

1. An apparatus for stacking sheets of a plurality of sizes, the apparatus comprising sheet supporting means for supporting a stack of sheets of a plurality of sizes;

sheet transport means for transporting sheets to form a stack of sheets of a plurality of sizes at the sheet supporting means;

a first set of elongated members having different lengths and being rotatable about a first common axis;

rotatable means for rotating each member of the first set individually about the first common axis; and data processing means for (i) controlling the sheet transport means to form a stack of sheets of a plurality of sizes at the sheet supporting means, and (ii) controlling the rotatable means to rotate each member of the first set individually to a particular position such that the member acts as a stop for sheets of a particular size to allow a stack of sheets of a plurality of sizes to be formed.

2. An apparatus according to claim 1, wherein the rotatable means includes a plurality of cams rotatable about a second common axis.

3. An apparatus according to claim 1, further comprising a second set of elongated members rotatable about the first common axis.

4. An apparatus according to claim 1, wherein the first set includes a number between two and ten elongated members.

5. An apparatus according to claim 1, wherein the first set includes five elongated members.

6. An apparatus according to claim 1, wherein the data processing means controls the rotatable means to rotate the elongated members in the first set individually in order of length beginning with the shortest elongated member.

7. An apparatus according to claim 1, further comprising engaging means for engaging a stack being formed at the sheet supporting means.

8. An apparatus according to claim 7, wherein the engaging means includes at least part of at least one member.

9. An apparatus according to claim 8, wherein the engaging means includes at least one flexible strap flicking wheel.

10. An apparatus for stacking sheets of a plurality of sizes, the apparatus comprising:

a sheet support for supporting a stack of sheets of a plurality of sizes;

a sheet transport mechanism for transporting sheets to form a stack of sheets of a plurality of sizes at the sheet support;

a first set of elongated members having different lengths and being rotatable about a first common axis;

a rotatable mechanism for rotating each member of the first set individually about the first common axis; and a processor for (i) controlling the sheet transport mechanism to form a stack of sheets of a plurality of sizes at the sheet support, and (ii) controlling the rotatable mechanism to rotate each member of the first set individually to a particular position such that the member acts as a stop for sheets of a particular size to allow a stack of sheets of a plurality of sizes to be formed.

11. An apparatus according to claim 10, wherein the rotatable mechanism includes a plurality of cams rotatable about a second common axis.

12. An apparatus according to claim 10, further comprising a second set of elongated members rotatable about the first common axis.

13. An apparatus according to claim 10, wherein the first set includes a number between two and ten elongated members.

14. An apparatus according to claim 10, wherein the first set includes five elongated members.

15. An apparatus according to claim 10, wherein the processor controls the rotatable mechanism to rotate the elongated members in the first set individually in order of length beginning with the shortest elongated member.

16. An apparatus according to claim 10, further comprising an engagement mechanism for engaging a stack being formed at the sheet support.

17. An apparatus according to claim 16, wherein the engagement mechanism includes at least part of at least one member.

18. An apparatus according to claim 17, wherein the engagement mechanism includes at least one flexible strap flicking wheel.

* * * * *